US011004412B2

(12) United States Patent
Xiao

(10) Patent No.: US 11,004,412 B2
(45) Date of Patent: May 11, 2021

(54) LIQUID CRYSTAL DISPLAY, OVERDRIVE METHOD FOR THE SAME AND A MEMORY

(71) Applicant: SHENZHEN CHINA STAR OPTOELECTRONICS TECHNOLOGY CO., LTD., Guangdong (CN)

(72) Inventor: Guangxing Xiao, Guangdong (CN)

(73) Assignee: SHENZHEN CHINA STAR OPTOELECTRONICS TECHNOLOGY CO., LTD., Guangdong (CN)

( * ) Notice: Subject to any disclaimer, the term of this patent is extended or adjusted under 35 U.S.C. 154(b) by 392 days.

(21) Appl. No.: 16/300,394

(22) PCT Filed: Aug. 7, 2018

(86) PCT No.: PCT/CN2018/099091
§ 371 (c)(1),
(2) Date: Nov. 9, 2018

(87) PCT Pub. No.: WO2020/015026
PCT Pub. Date: Jan. 23, 2020

(65) Prior Publication Data

US 2021/0110778 A1 Apr. 15, 2021

(30) Foreign Application Priority Data

Jul. 19, 2018 (CN) ..... 201810794096.1

(51) Int. Cl.
*G09G 3/36* (2006.01)

(52) U.S. Cl.
CPC ..... *G09G 3/3618* (2013.01); *G09G 2310/08* (2013.01)

(58) Field of Classification Search
CPC ..... G09G 3/3618; G09G 2310/08
(Continued)

(56) References Cited

U.S. PATENT DOCUMENTS 8,134,543 B1 * 3/2012 Han ..... G09G 5/008 345/204
2005/0162416 A1 7/2005 Bu et al.
(Continued)

FOREIGN PATENT DOCUMENTS

CN 107799086 3/2018
CN 107863080 3/2018
(Continued)

OTHER PUBLICATIONS

Lyons, R., "An Efficient Linear Interpolation Scheme", Dec. 2017, downloaded from web on Jan. 29, 2021 from https://www.dsprelated.com/showarticle/1123.php) (Year: 2017).*

*Primary Examiner* — Mark Edwards
(74) *Attorney, Agent, or Firm* — Leong C. Lei

(57) ABSTRACT

A liquid crystal display, an overdrive method and a memory are disclosed. The method includes steps of receiving a video source signal, and determining a real-time refresh frequency of the video source signal, obtaining overdrive values corresponding to at least two refresh frequencies of the liquid crystal display measured in advance, wherein the at least two refresh frequencies include a first refresh frequency and a second refresh frequency, and the real-time refresh frequency is greater than the first refresh frequency and less than the second refresh frequency, performing a linear interpolation according to the real-time refresh frequency, the first refresh frequency, a first overdrive value corresponding to the first refresh frequency, the second refresh frequency, and a second overdrive value corresponding to the second refresh frequency to obtain a real-time overdrive value corresponding to the real-time refresh frequency, and driving the liquid crystal display according to the real-time overdrive value.

8 Claims, 2 Drawing Sheets

(58) Field of Classification Search
USPC ..... 345/55
See application file for complete search history.

(56) References Cited

U.S. PATENT DOCUMENTS

| | | | | |
|---|---|---|---|---|
| 2015/0228248 | A1* | 8/2015 | Croxford | G09G 5/395 345/690 |
| 2017/0084235 | A1* | 3/2017 | Yeo | G09G 3/3648 |
| 2017/0256211 | A1* | 9/2017 | Miyata | G09G 3/3607 |

FOREIGN PATENT DOCUMENTS

| | | |
|---|---|---|
| CN | 107945756 | 4/2018 |
| KR | 101356164 B1 * | 1/2014 |

* cited by examiner

LIQUID CRYSTAL DISPLAY, OVERDRIVE METHOD FOR THE SAME AND A MEMORY

RELATED APPLICATIONS

The present application is a National Phase of International Application Number PCT/CN2018/099091, filed Aug. 7, 2018, and claims the priority of China Application No. 201810794096.1 filed Jul. 19, 2018.

FIELD OF THE INVENTION

The present invention relates to a liquid crystal display technology field, and more particularly to a liquid crystal display, an overdrive method for the same and a memory.

BACKGROUND OF THE INVENTION

A liquid crystal display is a flat, ultra-thin display device that consists of a number of colored or black-and-white pixels placed in front of a light source or a reflective surface. The liquid crystal display has features of low power consumption, high image quality, small size, and light weight. Therefore, the liquid crystal display are favored by everyone and become the mainstream of displays. At present, liquid crystal display is mainly a thin-film transistor liquid crystal display, and the liquid crystal panel is the main component of the liquid crystal display. The liquid crystal panel generally includes a color film substrate and a TFT array substrate which are disposed oppositely, and a liquid crystal layer disposed between the two substrates. With the development of flat panel display technology, people have higher and higher requirements on the quality of the screen, including brightness, color, resolution, viewing angle, refresh speed and so on.

In the driving process of the liquid crystal display panel, due to the limited reaction speed of the liquid crystal, it is difficult to achieve a desired deflection angle within one frame time, the display brightness is not expected, and the dynamic picture shows a tailing. In order to overcome the above defects, an over driver (OD) technology is proposed to make the liquid crystal achieve the desired deflection target in a short time. The principle of the OD technology is: setting N to a positive integer, when switching from a (N−1)-th frame to an N-th frame, if it is necessary to change from a grayscale level Gn−1 to a grayscale level Gn, if only the driving voltage of the corresponding grayscale level Gn is provided, since the reaction speed of the liquid crystal inversion is slow, the grayscale level Gn of the N-th frame cannot be actually achieved. Using the OD technology, providing a driving voltage of the grayscale level Gn' having a voltage difference greater than a voltage corresponding to the grayscale level Gn−1 in order to accelerate the liquid crystal turning speed, reaching the actual required grayscale level Gn' in the N-th frame to solve the technical problem.

In the current overdrive technology, an overdrive lookup table corresponding to a specific refresh frequency is stored in the liquid crystal display, and the liquid crystal display panel is driven according to the overdrive value in the overdrive lookup table. However, in the actual working process, the refresh frequency of the liquid crystal display will change. At this time, when the overdrive lookup table corresponding to a certain specific refresh frequency is operated, and the adaptive change cannot be made with the change of the refresh frequency so that the display effect is poor.

SUMMARY OF THE INVENTION

In order to solve the above-mentioned deficiencies of the prior art, an object of the present invention to provide a liquid crystal display, a driving method and a memory which can be adaptively driven in accordance with a change in refresh frequency.

In order to achieve the above purpose, the present invention adopts following technology solution: an overdrive method for liquid crystal display, comprising steps of: S1: receiving a video source signal, and determining a real-time refresh frequency of the video source signal according to the video source signal; S2: obtaining overdrive values corresponding to at least two refresh frequencies of the liquid crystal display measured in advance, wherein the at least two refresh frequencies include a first refresh frequency and a second refresh frequency, and the real-time refresh frequency is greater than the first refresh frequency and less than the second refresh frequency; S3: performing a linear interpolation according to the real-time refresh frequency, the first refresh frequency, a first overdrive value corresponding to the first refresh frequency, the second refresh frequency, and a second overdrive value corresponding to the second refresh frequency to obtain a real-time overdrive value corresponding to the real-time refresh frequency; and S4: driving the liquid crystal display according to the real-time overdrive value corresponding to the obtained real-time refresh frequency.

Optionally, the step 2 specifically comprises steps of: respectively obtaining overdrive values corresponding to a minimum refresh frequency, a normal refresh frequency, and a maximum refresh frequency of the liquid crystal display, wherein the normal refresh frequency is greater than the minimum refresh frequency and less than the maximum refresh frequency; comparing the normal refresh frequency with the real-time refresh frequency, when the real-time refresh frequency is greater than the normal refresh frequency, respectively setting the normal refresh frequency and the maximum refresh frequency as the first refresh frequency and the second refresh frequency; when the real-time refresh frequency is less than the normal refresh frequency, respectively setting the minimum refresh frequency and the normal refresh frequency as the first refresh frequency and the second refresh frequency.

Or, the step 2 specifically comprises steps of: obtaining overdrive values corresponding to at least four different refresh frequencies of the liquid crystal display, wherein the at least four different refresh frequencies have multiple frequency intervals, and each frequency interval has a same size; and determining a frequency interval where the real-time refresh frequency is located, and respectively setting refresh frequencies at both ends of the frequency interval where the real-time refresh frequency is located as the first refresh frequency and the second refresh frequency.

Optionally, in the step 3, a calculation formula of a real-time overdrive value corresponding to the real-time refresh frequency is:

$$y = \frac{(x2 - x) * y1}{x2 - x1} + \frac{(x - x1) * y2}{x2 - x1}$$

wherein, x1 is the first refresh frequency, y1 is the first overdrive value, is the second refresh frequency, y2 is the second overdrive value, X is a real-time refresh frequency, y is the real-time overdrive value.

Optionally, determining the minimum refresh frequency, the normal refresh frequency, and the maximum refresh frequency according to a specification of a timing controller of the liquid crystal display.

Optionally, the step S1 specifically comprises steps of: obtaining a pixel clock signal frequency according to the video source signal; and obtaining the real-time refresh frequency of the video source signal according to the pixel clock signal frequency and a refresh frequency calculation formula.

Optionally, the refresh frequency calculation formula is: Refrash=pixel_clk/(V_total*H_total); wherein, Refrash is the real-time refresh frequency of the liquid crystal display, pixel_clk is a pixel dock signal frequency, V_total is the number of rows in a vertical direction, that is, the number of rows of pixels in the display panel, H_total is the number of pixels in a horizontal direction.

Optionally, the step of obtaining a pixel clock signal frequency according to the video source signal comprise steps of: generating at least two sampling clock signals that are sequentially phase-shifted and have a same frequency; collecting a high voltage level of the pixel dock signal through the sampling dock signals, and calculating the number of sampling clock signals that collect the high voltage level of the pixel clock signal; calculating a high-level duration T of the pixel dock signal according to the number n of sampling clock signals that collect the high voltage level of the pixel dock signal; calculating the pixel dock signal frequency according to the high-level duration T of the pixel clock signal, and the pixel dock signal frequency is equal to 1/(2T); wherein a period of the sampling dock signal is greater than twice of a period of the clock signal; wherein a calculation formula of the high-level duration T of the pixel dock signal is T=n*t, wherein n is the number of sampling clock signals that collect the high voltage level of the pixel clock signal, and t is a time interval between adjacent two sampling clock signals.

The present invention discloses a liquid crystal display device, comprising: a determination module used for receiving a video source signal, and determining a real-time refresh frequency of the video source signal according to the video source signal; an obtaining module used for obtaining overdrive values corresponding to at least two refresh frequencies of the liquid crystal display measured in advance, wherein the at least two refresh frequencies include a first refresh frequency and a second refresh frequency, and the real-time refresh frequency is greater than the first refresh frequency and less than the second refresh frequency: an interpolation module used for performing a linear interpolation according to the real-time refresh frequency, the first refresh frequency, a first overdrive value corresponding to the first refresh frequency, the second refresh frequency, and a second overdrive value corresponding to the second refresh frequency to obtain a real-time overdrive value corresponding to the real-time refresh frequency; and a drive module used for driving the liquid crystal display according to the real-time overdrive value corresponding to the obtained real-time refresh frequency.

The present invention also disclose a memory, wherein the memory stores multiple instructions, the multiple instructions being adapted to be loaded and executed by a processor for following steps: receiving a video source signal, and determining a real-time refresh frequency of the video source signal according to the video source signal; obtaining overdrive values corresponding to at least two refresh frequencies of the liquid crystal display measured in advance, wherein the at least two refresh frequencies include a first refresh frequency and a second refresh frequency, and the real-time refresh frequency is greater than the first refresh frequency and less than the second refresh rate; performing a linear interpolation according to the real-time refresh frequency, the first refresh frequency, a first overdrive value corresponding to the first refresh frequency, the second refresh frequency, and a second overdrive value corresponding to the second refresh frequency to obtain a real-time overdrive value corresponding to the real-time refresh frequency; and driving the liquid crystal display according to the real-time overdrive value corresponding to the obtained real-time refresh frequency.

Beneficial effect: the overdrive method for liquid crystal display provided by the embodiment of the present invention performs the linear interpolation according to the real-time refresh frequency of the liquid crystal display and the overdrive values corresponding to the first refresh frequency and the second refresh frequency measured in advance in order to obtain a real-time overdrive value such that the liquid crystal display has a good display effect at different refresh frequencies.

DETAILED DESCRIPTION OF PREFERRED EMBODIMENTS

In order to make the objects, technical solutions and advantages of the present invention more clear, the present invention will be further described in detail with reference to the accompanying drawings and embodiments. It is understood that the specific embodiments described herein are merely illustrative of the invention and are not intended to limit the invention.

First Embodiment

Figure 1:
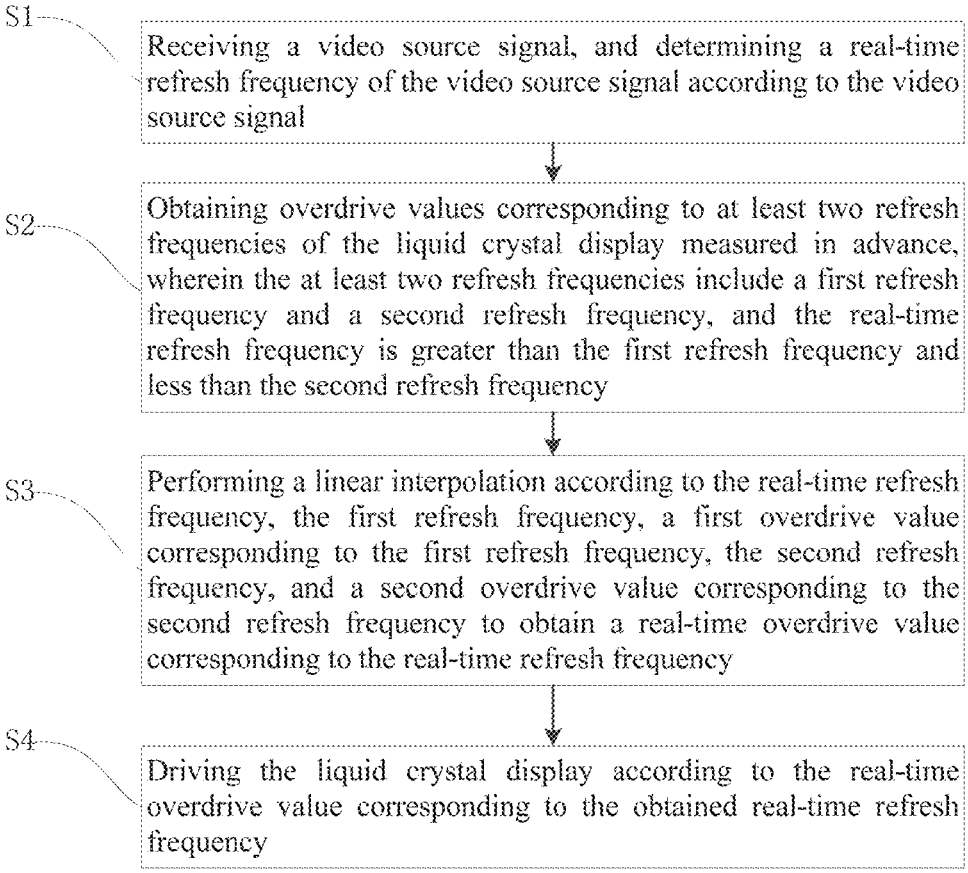
FIG. 1 is a flowchart of an overdrive method according to a first embodiment of the present invention.

FIG. 1 is a flow chart of an overdrive method for liquid crystal display according to a first embodiment of the present invention, the overdrive method includes steps S1 to S4:

Specifically, step S1: receiving a video source signal, and determining a real-time refresh frequency of the video source signal according to the video source signal.

As a preferred embodiment, the step S1 specifically includes steps S11 to S12:

Step S11: obtaining a pixel clock signal frequency according to the video source signal.

Furthermore, the step S11 includes steps S111 to S115:

The step S111: generating at least two sampling clock signals that are sequentially phase-shifted and have a same frequency. As a preferred embodiment, using a Phase Locked Loop (PLL) in the timing controller of the liquid crystal display to generate seven sequentially phase-shifted sampling clock signals clk1, clk2, clk3, clk4, clk5, clk6, and clk7. Of course, in another embodiment, the phase locked loop can also generate other numbers of sequentially phase-shifted sampling clock signals.

Figure 2:
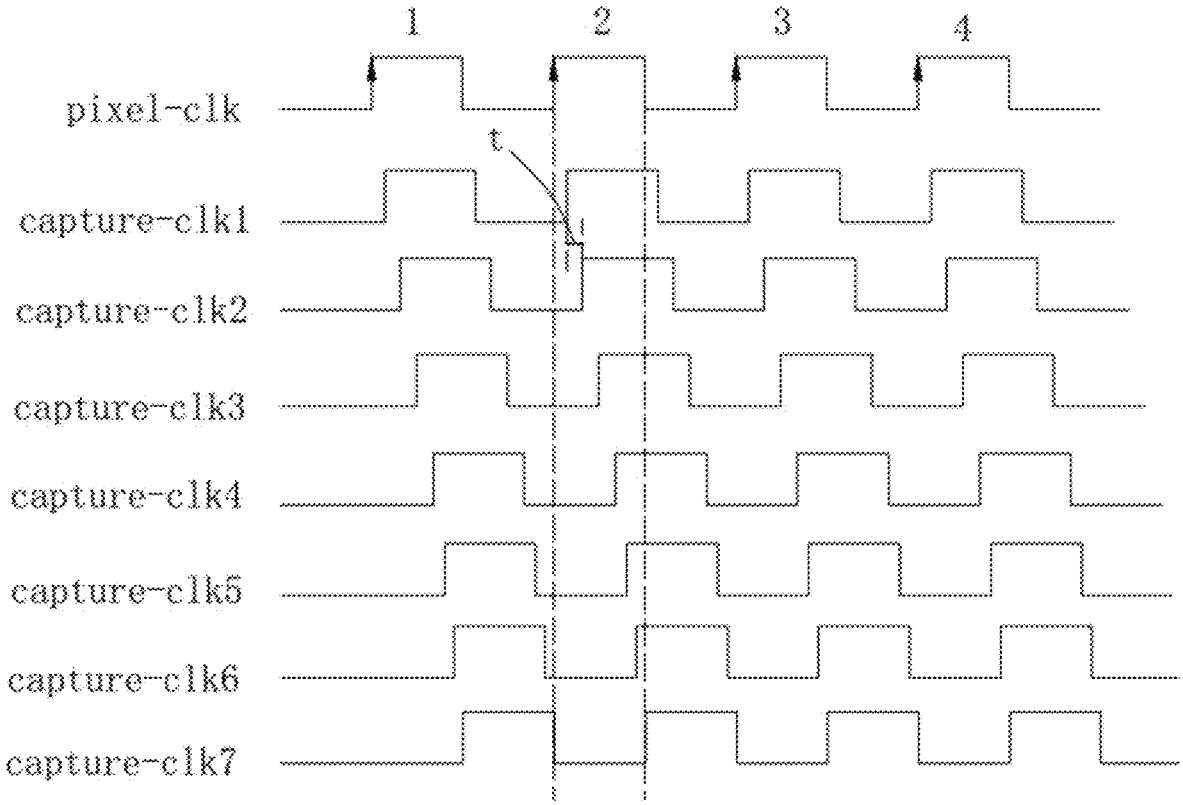
FIG. 2 is a schematic diagram of collecting a pixel clock signal frequency according to the first embodiment of the present invention.

Step S112: collecting a high voltage level of the pixel clock signal through the sampling clock signals, and calculating the number of sampling clock signals that collect the high voltage level of the pixel clock signal. As a preferred embodiment, as shown in FIG. 2, among the seven sequentially phase-shifted sampling clock signals generated by the phase locked loop, six sampling clock signals clk1, clk2, clk3, clk4, clk5, and clk6 collect the high voltage level of the pixel clock signal. That is, the number n of sampling clock signals that collect the high voltage level of the pixel clock signal is 6.

Step S113: calculating a high-level duration T of the pixel clock signal according to the number n of sampling clock signals that collect the high voltage level of the pixel clock signal. Wherein an interval between two adjacent sampling clock signals is t, and the high-level duration T of the pixel clock signal is calculated as T=n*t. As a preferred embodiment, T=6t.

Step S114: calculating the pixel clock signal frequency according to the high-level duration T of the pixel clock signal, and the pixel clock signal frequency is equal to 1/(2T). In the liquid crystal display, generally, the duty ratios of the high voltage level and the low voltage level of the pixel clock signal are generally 50%, respectively. In the preferred embodiment, the pixel dock signal frequency is equal to 1/(12t).

In order to prevent a malfunction, improving the accuracy of the tested pixel clock signal frequency, the pixel clock signal frequency is an average value of the pixel dock signal frequencies within one frame, through sampling the high voltage level of the pixel clock signal by the sampling dock signals repeatedly, calculating multiple frequencies of the pixel dock signal, calculating an average value of multiple frequencies of the pixel dock signal, using the average value of the multiple frequencies of the pixel clock signal as the frequency of the pixel clock signal for calculating the real-time refresh frequency.

Of course, in another embodiments, the interval t between two adjacent sampling dock signals can also be reduced as much as possible to sample a larger number of sampling dock signals to further reduce the test error of the pixel dock signal frequency.

Step S12: obtaining the real-time refresh frequency of the video source signal according to the pixel dock signal frequency and a refresh frequency calculation formula.

As a preferred embodiment, the refresh frequency calculation formula is:

$$\text{Refrash}=\text{pixel_}clk(V_\text{total}*H_\text{total})$$

Wherein, Refrash is the real-time refresh frequency of the liquid crystal display, pixel_clk is a pixel dock signal frequency, V_total is the number of rows in a vertical direction, that is, the number of rows of pixels in the display panel, H_total is the number of pixels in a horizontal direction, that is, the total number of pixels of each row.

Step S2: obtaining overdrive values corresponding to at least two refresh frequencies of the liquid crystal display measured in advance, wherein the at least two refresh frequencies include a first refresh frequency and a second refresh frequency, and the real-time refresh frequency is greater than the first refresh frequency and less than the second refresh frequency.

As a preferred embodiment, the step S2 includes steps S21 to S22:

Step S21: respectively obtaining overdrive values corresponding to a minimum refresh frequency, a normal refresh frequency, and a maximum refresh frequency of the liquid crystal display, wherein the normal refresh frequency is greater than the minimum refresh frequency and less than the maximum refresh frequency.

Specifically, determining the minimum refresh frequency, the normal refresh frequency, and the maximum refresh frequency according to a specification of a timing controller of the liquid crystal display, and parameters corresponding to different specifications of the timing controller are different, as a preferred embodiment, the minimum refresh frequency is selected as 40 Hz, and the normal refresh rate is selected as 60 Hz and the maximum refresh rate is selected as 80 Hz.

Step S22: Comparing the normal refresh frequency with the real-time refresh frequency. When the real-time refresh frequency is greater than the normal refresh frequency, for example, the real-time refresh frequency is 65 Hz, and the real-time refresh frequency is greater than the normal refresh frequency, and respectively setting the normal refresh frequency and the maximum refresh frequency as the first refresh frequency and the second refresh frequency, that is, the first refresh frequency is 60 Hz, and the second refresh frequency is 80 Hz.

Furthermore, when the real-time refresh frequency is less than the normal refresh frequency, for example, the real-time refresh frequency is 55 Hz, the real-time refresh frequency is less than the normal refresh frequency, and respectively setting the minimum refresh frequency and the normal refresh frequency as the first refresh frequency and the second refresh frequency. That is, the first refresh frequency is 40 Hz, and the second refresh frequency is 60 Hz.

Step S3: performing a linear interpolation according to the real-time refresh frequency, the first refresh frequency, a first overdrive value corresponding to the first refresh frequency, the second refresh frequency, and a second overdrive value corresponding to the second refresh frequency to obtain a real-time overdrive value corresponding to the real-time refresh frequency.

As a preferred embodiment, a calculation formula of a real-time overdrive value corresponding to the real-time refresh frequency is:

$$y = \frac{(x2 - x) * y1}{x2 - x1} + \frac{(x - x1) * y2}{x2 - x1}$$

Wherein, x1 is the first refresh frequency, y1 is the first overdrive value, x2 is the second refresh frequency, y2 is the second overdrive value, x is a real-time refresh frequency, y is the real-time overdrive value, x1 and x2 are two nearest frequency values to x. Specifically, in the preferred embodiment, when the real-time frequency x=65 Hz, x1=60 Hz, x2=80 Hz. When the real-time refresh frequency x=55 Hz, x1=40 Hz, x2=60 Hz.

Step S4: driving the liquid crystal display according to the real-time overdrive value corresponding to the obtained real-time refresh frequency.

The overdrive method for liquid crystal display provided by the embodiment of the present invention performs the linear interpolation according to the real-time refresh frequency of the liquid crystal display and the overdrive values corresponding to the first refresh frequency and the second refresh frequency measured in advance in order to obtain a real-time overdrive value, so that the liquid crystal display has a good display effect at different refresh frequencies.

Second Embodiment

The overdrive method for liquid crystal display according to the second embodiment of the present invention includes steps S1' to S4':

Specifically, step S1': receiving a video source signal, and determining a real-time refresh frequency of the video source signal according to the video source signal. This step S1' is the same as step S1 in the first embodiment, and details are not described herein again.

Step S2': obtaining overdrive values corresponding to at least two refresh frequencies of the liquid crystal display measured in advance, wherein the at least two refresh frequencies include a first refresh frequency and a second refresh frequency, and the real-time refresh frequency is greater than the first refresh frequency and less than the second refresh rate.

As a preferred embodiment, the step S2' includes steps S21' to S22':

Step S21': obtaining overdrive values corresponding to at least four different refresh frequencies of the liquid crystal display, wherein the at least four different refresh frequencies have multiple frequency intervals, and each frequency interval has a same size.

As a preferred embodiment, the obtained refresh frequencies of the liquid crystal display are 40 Hz, 50 Hz, 60 Hz, 70 Hz, and 80 Hz, wherein the first frequency interval is 40 Hz to 50 Hz, the second frequency interval is 50 Hz to 60 Hz, and the third frequency interval is 60 Hz to 70 Hz. The fourth frequency interval is 70 Hz to 80 Hz, and the size of each frequency interval is 10 Hz.

Step S22': determining a frequency interval where the real-time refresh frequency is located, and respectively setting refresh frequencies at both ends of the frequency interval where the real-time refresh frequency is located as the first refresh frequency and the second refresh frequency.

As a preferred embodiment, when the real-time refresh frequency is 65 Hz, and the real-time refresh frequency is located in the third frequency interval, the first refresh frequency is set as 60 Hz, and the second refresh frequency is set as 70 Hz. When the real-time refresh frequency is 55 Hz, and the real-time refresh frequency is in the second frequency interval, the first refresh frequency is set as 50 Hz, and the second refresh frequency is set as 60 Hz.

Of course, in other embodiments, each frequency interval size can also be set to other values, and the frequency interval should be reduced as much as possible to further improve the accuracy of the real-time overdrive value obtained by the interpolation calculation.

Step S3': performing a linear interpolation according to the real-time refresh frequency, the first refresh frequency, the first overdrive value corresponding to the first refresh frequency, the second refresh frequency, and the second overdrive value corresponding to the second refresh frequency to obtain a real-time overdrive value corresponding to the real-time refresh frequency.

This step S3' is the same as the calculation method of step S3 in the first embodiment, and details are not described herein again.

Step S4': driving the liquid crystal display according to the real-time overdrive value corresponding to the obtained real-time refresh frequency.

Third Embodiment

Figure 3:
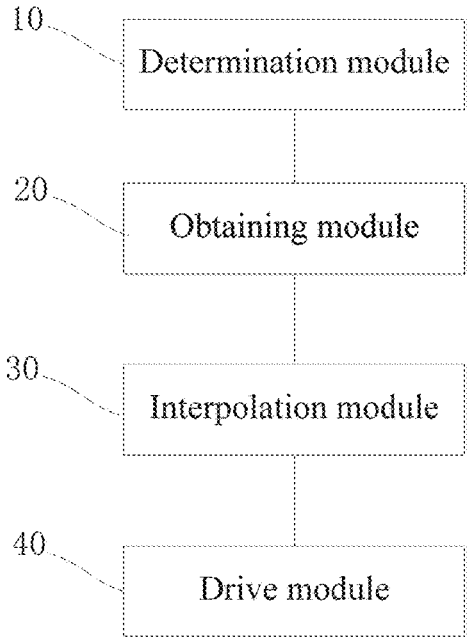
FIG. 3 is a schematic block diagram of a liquid crystal display according to a third embodiment of the present invention.

As shown in FIG. 3, the liquid crystal display according to the third embodiment of the present invention includes:

a determination module 10 used for receiving a video source signal, and determining a real-time refresh frequency of the video source signal according to the video source signal;

an obtaining module 20 used for obtaining overdrive values corresponding to at least two refresh frequencies of the liquid crystal display measured in advance, wherein the at least two refresh frequencies include a first refresh frequency and a second refresh frequency, and the real-time refresh frequency is greater than the first refresh frequency and less than the second refresh frequency;

an interpolation module 30 used for performing a linear interpolation according to the real-time refresh frequency, the first refresh frequency, a first overdrive value corresponding to the first refresh frequency, the second refresh frequency, and a second overdrive value corresponding to the second refresh frequency to obtain a real-time overdrive value corresponding to the real-time refresh frequency;

a drive module 40 used for driving the liquid crystal display according to the real-time overdrive value corresponding to the obtained real-time refresh frequency.

Fourth Embodiment

A memory according to the fourth embodiment of the present invention stores multiple instructions, the multiple instructions being adapted to be loaded and executed by a processor:

receiving a video source signal, and determining a real-time refresh frequency of the video source signal according to the video source signal;

obtaining overdrive values corresponding to at least two refresh frequencies of the liquid crystal display measured in advance, wherein the at least two refresh frequencies include a first refresh frequency and a second refresh frequency, and the real-time refresh frequency is greater than the first refresh frequency and less than the second refresh rate;

performing a linear interpolation according to the real-time refresh frequency, the first refresh frequency, a first overdrive value corresponding to the first refresh frequency, the second refresh frequency, and a second overdrive value corresponding to the second refresh frequency to obtain a real-time overdrive value corresponding to the real-time refresh frequency; and driving the liquid crystal display according to the real-time overdrive value corresponding to the obtained real-time refresh frequency.

The embodiments of the present invention have been described in detail above, although some embodiments have been shown and described, those skilled in the art will understand, without departing from the spirit and scope of the invention, the scope of the invention, these embodiments may be modified and improved, and such modifications and improvements are also intended to be within the scope of the present invention.

What is claimed is:

1. An overdrive method for liquid crystal display, comprising steps of:

S1: receiving a video source signal, and determining a real-time refresh frequency of the video source signal according to the video source signal;

S2: obtaining overdrive values corresponding to at least two refresh frequencies of the liquid crystal display measured in advance, wherein the at least two refresh frequencies include a first refresh frequency and a second refresh frequency, and the real-time refresh frequency is greater than the first refresh frequency and less than the second refresh frequency;

S3: performing a linear interpolation according to the real-time refresh frequency, the first refresh frequency, a first overdrive value corresponding to the first refresh frequency, the second refresh frequency, and a second overdrive value corresponding to the second refresh frequency to obtain a real-time overdrive value corresponding to the real-time refresh frequency; and S4: driving the liquid crystal display according to the real-time overdrive value corresponding to the obtained real-time refresh frequency;

wherein the step S1 specifically comprises steps of:

obtaining a pixel clock signal frequency according to the video source signal; and obtaining the real-time refresh frequency of the video source signal according to the pixel clock signal frequency and a refresh frequency calculation formula; and wherein the step of obtaining a pixel clock signal frequency according to the video source signal comprise steps of:

generating at least two sampling clock signals that are sequentially phase-shifted and have a same frequency;

collecting a high voltage level of the pixel clock signal through the sampling clock signals, and calculating the number of sampling clock signals that collect the high voltage level of the pixel clock signal;

calculating a high-level duration T of the pixel clock signal according to the number n of sampling clock signals that collect the high voltage level of the pixel clock signal;

calculating the pixel clock signal frequency according to the high-level duration T of the pixel clock signal, and the pixel clock signal frequency is equal to 1/(2T);

wherein a calculation formula of the high-level duration T of the pixel clock signal is T=n*t, wherein n is the number of sampling clock signals that collect the high voltage level of the pixel clock signal, and t is a time interval between adjacent two sampling clock signals.

2. The overdrive method for liquid crystal display according to claim 1, wherein the step 2 specifically comprises steps of:

respectively obtaining overdrive values corresponding to a minimum refresh frequency, a normal refresh frequency, and a maximum refresh frequency of the liquid crystal display, wherein the normal refresh frequency is greater than the minimum refresh frequency and less than the maximum refresh frequency;

comparing the normal refresh frequency with the real-time refresh frequency, when the real-time refresh frequency is greater than the normal refresh frequency, respectively setting the normal refresh frequency and the maximum refresh frequency as the first refresh frequency and the second refresh frequency; when the real-time refresh frequency is less than the normal refresh frequency, respectively setting the minimum refresh frequency and the normal refresh frequency as the first refresh frequency and the second refresh frequency.

3. The overdrive method for liquid crystal display according to claim 1, wherein the step 2 specifically comprises steps of:

obtaining overdrive values corresponding to at least four different refresh frequencies of the liquid crystal display, wherein the at least four different refresh frequencies have multiple frequency intervals, and each frequency interval has a same size; and determining a frequency interval where the real-time refresh frequency is located, and respectively setting refresh frequencies at both ends of the frequency interval where the real-time refresh frequency is located as the first refresh frequency and the second refresh frequency.

4. The overdrive method for liquid crystal display according to claim 1, wherein in the step 3, a calculation formula of a real-time overdrive value corresponding to the real-time refresh frequency is:

$$y = \frac{(x2 - x) * y1}{x2 - x1} + \frac{(x - x1) * y2}{x2 - x1}$$

wherein, x1 is the first refresh frequency, y1 is the first overdrive value, x2 is the second refresh frequency, y2 is the second overdrive value, x is a real-time refresh frequency, y is the real-time overdrive value.

5. The overdrive method for liquid crystal display according to claim 2, wherein determining the minimum refresh frequency, the normal refresh frequency, and the maximum refresh frequency according to a specification of a timing controller of the liquid crystal display.

6. The overdrive method for liquid crystal display according to claim 1, wherein the refresh frequency calculation formula is:

$$\text{Refresh}=\text{pixel_}clk/(V_\text{total}*H_\text{total});$$

Wherein Refresh is the real-time refresh frequency of the liquid crystal display, pixel_clk is a pixel clock signal frequency, V_total is the number of rows in a vertical direction, that is, the number of rows of pixels in the display panel, H_total is the number of pixels in a horizontal direction.

7. A liquid crystal display device, comprising:

a determination module used for receiving a video source signal, and determining a real-time refresh frequency of the video source signal according to the video source signal;

an obtaining module used for obtaining overdrive values corresponding to at least two refresh frequencies of the liquid crystal display measured in advance, wherein the at least two refresh frequencies include a first refresh frequency and a second refresh frequency, and the real-time refresh frequency is greater than the first refresh frequency and less than the second refresh frequency;

an interpolation module used for performing a linear interpolation according to the real-time refresh frequency, the first refresh frequency, a first overdrive value corresponding to the first refresh frequency, the second refresh frequency, and a second overdrive value corresponding to the second refresh frequency to obtain a real-time overdrive value corresponding to the real-time refresh frequency; and a drive module used for driving the liquid crystal display according to the real-time overdrive value corresponding to the obtained real-time refresh frequency;

wherein the determination module determines the real-time refresh frequency of the video source signal by performing the following operations:

obtaining a pixel clock signal frequency according to the video source signal; and obtaining the real-time refresh frequency of the video source signal according to the pixel clock signal frequency and a refresh frequency calculation formula; and wherein the pixel clock signal frequency is obtained by performing the following operations:

generating at least two sampling clock signals that are sequentially phase-shifted and have a same frequency;

collecting a high voltage level of the pixel clock signal through the sampling clock signals, and calculating the number of sampling clock signals that collect the high voltage level of the pixel clock signal;

calculating a high-level duration T of the pixel clock signal according to the number n of sampling clock signals that collect the high voltage level of the pixel clock signal;

calculating the pixel clock signal frequency according to the high-level duration T of the pixel clock signal, and the pixel clock signal frequency is equal to 1/(2T);

wherein a calculation formula of the high-level duration T of the pixel clock signal is T=n*t, wherein n is the number of sampling clock signals that collect the high voltage level of the pixel clock signal, and t is a time interval between adjacent two sampling clock signals.

8. A memory, wherein the memory stores multiple instructions, the multiple instructions being adapted to be loaded and executed by a processor for following steps:

receiving a video source signal, and determining a real-time refresh frequency of the video source signal according to the video source signal;

obtaining overdrive values corresponding to at least two refresh frequencies of the liquid crystal display measured in advance, wherein the at least two refresh frequencies include a first refresh frequency and a second refresh frequency, and the real-time refresh frequency is greater than the first refresh frequency and less than the second refresh rate;

performing a linear interpolation according to the real-time refresh frequency, the first refresh frequency, a first overdrive value corresponding to the first refresh frequency, the second refresh frequency, and a second overdrive value corresponding to the second refresh frequency to obtain a real-time overdrive value corresponding to the real-time refresh frequency; and driving the liquid crystal display according to the real-time overdrive value corresponding to the obtained real-time refresh frequency;

wherein the step S1 specifically comprises steps of:

obtaining a pixel clock signal frequency according to the video source signal; and obtaining the real-time refresh frequency of the video source signal according to the pixel clock signal frequency and a refresh frequency calculation formula; and wherein the step of obtaining a pixel clock signal frequency according to the video source signal comprise steps of:

generating at least two sampling clock signals that are sequentially phase-shifted and have a same frequency;

collecting a high voltage level of the pixel clock signal through the sampling clock signals, and calculating the number of sampling clock signals that collect the high voltage level of the pixel clock signal;

calculating a high-level duration T of the pixel clock signal according to the number n of sampling clock signals that collect the high voltage level of the pixel clock signal;

calculating the pixel clock signal frequency according to the high-level duration T of the pixel clock signal, and the pixel clock signal frequency is equal to 1/(2T);

wherein a calculation formula of the high-level duration T of the pixel clock signal is T=n*t, wherein n is the number of sampling clock signals that collect the high voltage level of the pixel clock signal, and t is a time interval between adjacent two sampling clock signals.

* * * * *